United States Patent [19]

Kirii et al.

[11] Patent Number: 4,698,991

[45] Date of Patent: Oct. 13, 1987

[54] METHOD OF AND APPARATUS FOR CONTROLLING FORMING PRESS CONDITIONS

[75] Inventors: Kazunari Kirii; Mamoru Toyoda; Masatoki Utsumi; Akio Asai, all of Toyota, Japan

[73] Assignee: Toyota Jidosha Kabushiki Kaisha, Toyota, Japan

[21] Appl. No.: 766,359

[22] Filed: Aug. 16, 1985

[30] Foreign Application Priority Data

Apr. 6, 1985 [JP] Japan ..... 60-73126

[51] Int. Cl.[4] ..... B30B 15/16

[52] U.S. Cl. ..... 62/21; 72/20; 72/8; 72/438; 364/476

[58] Field of Search ..... 72/19, 20, 21, 6, 8, 72/9, 11, 13, 15, 438, 417, 350, 351; 173/5, 8, 19, 21; 364/472, 476

[56] References Cited

U.S. PATENT DOCUMENTS 4,116,122 9/1978 Linder et al. ..... 72/19

FOREIGN PATENT DOCUMENTS 2353952 5/1974 Fed. Rep. of Germany ..... 72/20

915990 3/1982 U.S.S.R. ..... 72/20

*Primary Examiner*—Robert L. Spruill

*Assistant Examiner*—David B. Jones

*Attorney, Agent, or Firm*—Cushman, Darby & Cushman

[57] ABSTRACT

A method of and apparatus for controlling forming press conditions aids in maintaining stability in a mechanical double action press forming provided with an upper die (inner) and an outer ram (outer). These dies are driven independently wherein press conditions related to the forming process, such as a hydraulic pressure and pneumatic pressure, are automatically corrected by feedback so as to be maintained to preset values corresponding to the change of the inner stroke during the forming process. Abnormal operation can also be detected and corrected immediately by detecting the change of the press conditions during the forming process continuously or intermittently.

9 Claims, 4 Drawing Figures

METHOD OF AND APPARATUS FOR CONTROLLING FORMING PRESS CONDITIONS

BACKGROUND OF THE INVENTION

1. Field of the Invention

This invention relates to a method and apparatus for controlling press conditions of a mechanical double action press machine, and more particularly to a method and apparatus in which a function is provided which controls various conditions which are related to press forming, such as hydraulic pressure and pneumatic pressure, automatically by a feedback method.

2. Description of the Prior Art

A deep drawing mechanical double action press machine is shown in FIG. 3. This press is equipped with upper (inner) die 38 and outer ram 39. Outer ram 39 produces a pressure aided by the distortion of outer connection rods 40 at the lower dead point of lower die 37. Hydraulic pressure is supplied to outer connection rod connector parts 7, which are located at the point where outer connection rods 40 are attached to outer ram 39, to transmit the above-mentioned pressure and absorb the overload during the forming process.

Conventionally, a control system such as shown in FIG. 4 has been utilized as a means to control the hydraulic pressure.

The outer connection rod control part 7 consists of a cylinder (a protector cylinder) 42 which is drilled in outer ram 39 and a piston 43 which is housed in cylinder 42 and to which outer connection rod 40 is attached. An oil chamber 8 is defined by the piston 43 and the cylinder 42.

A hydroblank holder 18, which has an oil chamber 18*a* and an air chamber 18*b*, is also included in a control system of the prior art. Oil chamber 18*a* and oil chamber 8 of the outer connection rod connector part 7 are connected to each other. A predetermined hydraulic pressure is supplied to these two oil chambers 8 and 18*a* from a hydraulic source 46. Hydraulic source 46 typically includes a hydraulic motor 46*a*, and a pressure setting valve 46*b*. A predetermined pneumatic pressure is also supplied to air chamber 18*b* of the hydroblank holder 18 from a pneumatic source 47 which typically includes a regulating valve 47*a*, and an accumulator 47*b*.

With above configuration, the hydraulic pressure is balanced with the pneumatic pressure regulated by the regulating valve 47*a*, i.e., the air regulator pressure. Hydraulic pressure is applied to oil chamber 8 of outer connection rod connector part 7, and thus determines the pressure of the outer ram 39. In this case, when the predetermined pressure of the regulating valve 47*a* is varied, the hydraulic pressure balancing with it also changed as a result, hence varying the pressure of the outer ram 39.

When the internal pressure of an outer balance cylinder (the reference numeral 48 of FIG. 3) connected to the upper part of the outer ram 39 is regulated by a regulator (not shown) to a magnitude just sufficient to push up both the weight of the upper (inner) die and the weight of the outer ram at the time of the lower dead point of the press, an outer (outward) load corresponding to above predetermined hydraulic pressure is transmitted. Conversely, if the pressure is regulated by the regulator (not shown) to a magnitude exceeding the value just enough to push up the weight of the upper (inner) die (hereinafter referred to as inner die) and the weight of the outer ram at the time of the lower dead point of the press, the outer load with the magnitude obtained by reducing the excess upward pressure of the outer balance cylinder 48 (excess value of the regulator pressure) from the pressure corresponding to above predetermined hydraulic pressure is transmitted.

Also if the hydraulic pressure in the oil chamber (which is predetermined at the time of the upper dead point of the outer) is changed at the time of the lower dead point, the compression property of the operating oil is changed so that the above outer load is changed.

The prior art mentioned above has thus posed a problem as described below. The internal pressure of air chamber 18*b* of hydroblank holder 18, the internal pressure of outer balance cylinder 48 and the internal pressure of oil chamber 8 of the outer connection rod connector part 7 at the upper dead point of the press, greatly affect the forming characteristics of the pressing in the prior art. However, these pressures are manually set in advance by an operator at the upper dead point of the press, prior to the forming. Thus, the change in the desired pressure values at different times during the forming process cannot be determined.

Therefore, in order to manually preset the pressure in the prior art, not only have much labor and time been required, but also an abnormal change of the preset pressure at the time of the upper dead point cannot be determined, and hence forming has been carried out even when the outer load has shown an abnormal value at the time of the lower dead point. Thus, it has been difficult to maintain stability during the process.

Moreover, abnormal situations such as oil leakage in oil chambers 8 and 18*a*, oil accumulation in air chamber 18*b* and malfunction of hydroblank holder 18 at the time of forming have been very difficult to detect. Therefore, when such factors have caused a press to malfunction, those factors could not be identified, and the malfunction was inadequately corrected, for instance by adjusting the dies.

SUMMARY OF THE INVENTION

It is thus an object of the present invention to provide a method of and an apparatus for controlling forming press conditions to solve these problems of the prior art. This invention prevents production of defective products and facilitates stable press forming by automatically controlling press conditions related to the outer load during the forming process.

To this end, the present invention provides a method of controlling forming press conditions which has the function with which the change of an inner stroke in the press forming process of a mechanical double action press machine is detected. At the same time, (1) hydraulic pressure in an oil chamber of an outer connecting rod connector part, (2) a pneumatic pressure in a hydroblank holder air tank, and (3) an internal pressure of an outer balance tank are detected. Those detected pressures (hydraulic, pneumatic and internal) are then regulated so as to coincide to predetermined values.

The present invention also includes an apparatus for controlling forming conditions, which has a controller in which predetermined pressure values are memorized. The input of a series of data such as (1) information related to materials, (2) information related to dies and production lot size, and (3) various sensors and hydraulic/pneumatic pressure controlling apparatuses, are connected to the controller by signal systems. Within the conntroller, this data is memorized and compared to prestored values, thereby constituting a feedback circuit. Thus, a function is provided with which conditions on the press machine side, such a hydraulic/pneumatic pressure related to the press forming, are automatically controlled so as to obtain the required dynamic characteristics against the inner stroke of the machine.

Thus, the apparatus for controlling press conditions which is provided by the present invention has an inner stroke sensor which detects an inner stroke of a double action press machine. In addition, a hydraulic pressure sensor detects the internal pressure of an oil chamber of an outer connection rod connector part. A pneumatic pressure sensor detects the internal pressure of a hydroblank holder air tank, and a pressure sensor detects the internal pressure of an outer balance tank.

A hydraulic pressure controlling apparatus is provided in a circuit connected between the oil chamber of the outer connection rod connector part and a hydraulic source. A pneumatic pressure controlling apparatus is provided in a circuit connecting the hydroblank holder air tank and a pneumatic source. A pressure controlling apparatus is provided in a circuit connecting the outer balance tank and a pressure source. A controller is also provided which controls the operation of: (1) the hydraulic pressure controlling apparatus, (2) the pneumatic pressure controlling apparatus, and (3) the pressure controlling apparatus, in accordance with the signal from the inner stroke sensor, thereby obtaining desired or predetermined pressure values.

BRIEF DESCRIPTION OF THE DRAWINGS

An exemplary and presently preferred embodiment of the invention will be described in detail with reference to the accompanying drawings, wherein.

DESCRIPTION OF THE PREFERRED EMBODIMENT

Figure 1:
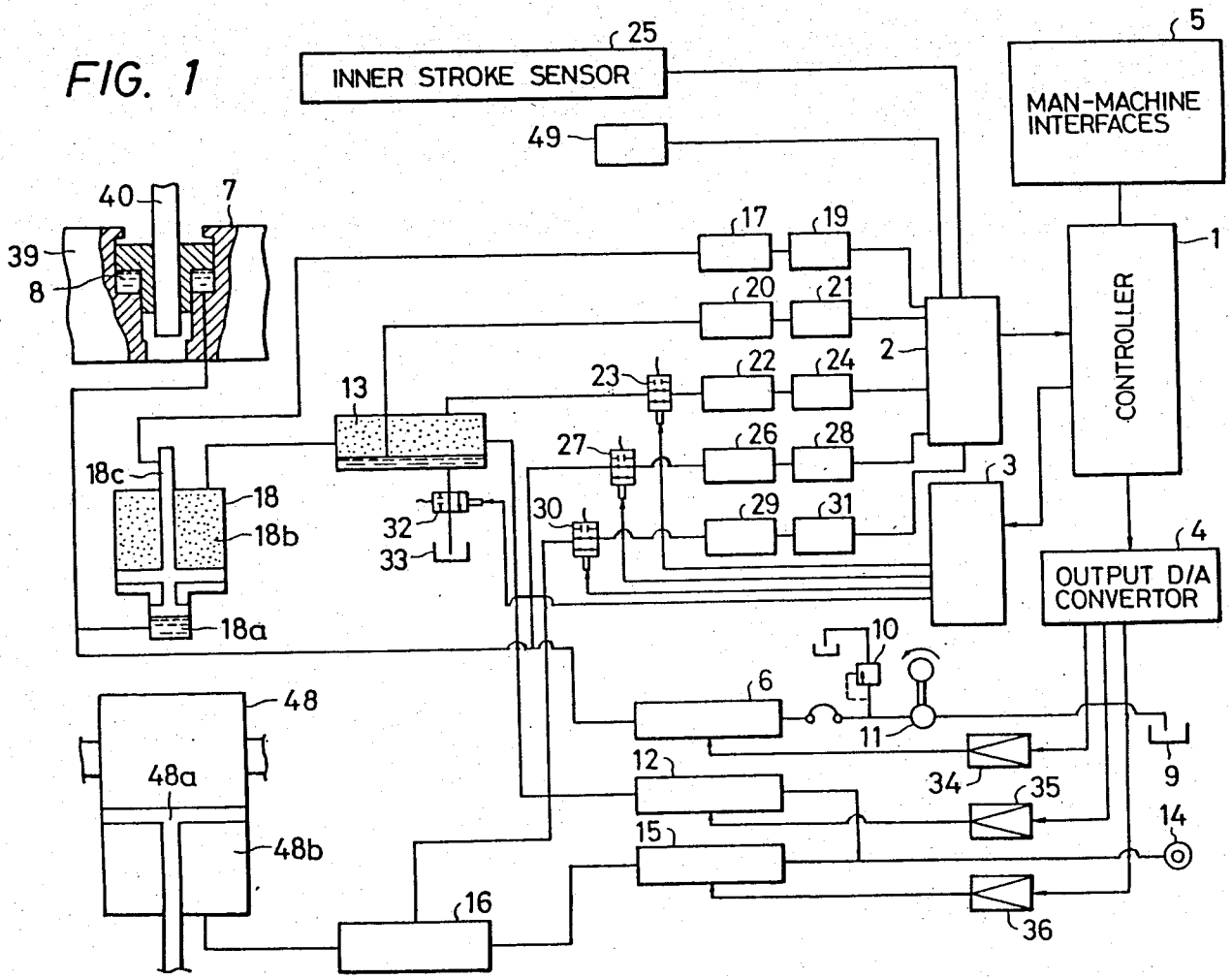
FIG. 1 is a block diagram of an apparatus for controlling forming press conditions provided by the present invention.

In the method for controlling forming press conditions provided by the present invention, the press forming conditions are automatically predetermined by collecting a series of data. This can include information related to materials, including type of the material, plate thickness, shape and the like, the information related to dies, carriers and production lot size. This allows the most suitable conditions, as determined by the above series of data at the time of die preparation, when both an outer ram and an inner die are positioned at the upper dead point. When the production lot size is large and the forming cycles exceed a predetermined number of turns, an irregular surface contact may occur as a result of the rise of the surface temperature of the die and troubles such as cracking and gouging may thus occur. To avoid this, the method of the present invention changes the pneumatic pressure of each hydroblank holder air tank either continuously or intermittently, corresponding to the change of the die surface temperature at every forming cycle, so that the smooth processing of the work is promoted.

A fluid quantity sensor 20 which detects oil accumulation in hydroblank holder air tank 13 is immediately detects oil leakage from the hydraulic system. Also, a displacement sensor 17 which detects the displacement of the piston rod 18*c* is provided in the hydroblank holder 13 to immediately detect any malfunction of the hydroblank holder 13. Controller 1 is equipped with a detected value indicating means which observes continually changing output values from those sensors either continuously or intermittently, at the proper times during the cycle, including the upper and lower dead points of the inner die. Thus, abnormal operation will be immediately detected.

In the apparatus of the present invention, during the press forming process, the inner stroke of the inner die is detected by the inner stroke sensor 25. A detecting signal indicative thereof is put into controller 1 and simultaneously, the internal pressure of the oil changer 8 of the outer connection rod connector part 7, the internal pressure of the hydroblank holder air tank 13 and the internal pressure of the outer balance tank 16 are properly detected by the hydraulic and pneumatic pressure sensors 26, 22 and 29, respectively. These respective detecting signals are also input into controller 1.

Controller 1 then compares the internal pressures of the oil chamber 8, hydroblank holder air tank holder tank and of outer balance tank 16 to prestored values. These values correspond to desired values for the inner stroke. These input detecting signals from above respective sensors thus allow controller 1 to make a judgement, and according to this adjustment, controller 1 transmits proper operation instruction signals to hydraulic pressure, pneumatic pressure and pressure controlling apparatuses 6, 12 and 15. Using the above method, the operations of these apparatuses can be automatically controlled, and the internal pressures of oil chamber 8 of outer connection rod connector part 7, hydroblank holder air tank 13 and of outer balance tank 16 are corrected automatically by feedback control. These pressures are thus caused to coincide to the respective prestored values in the controller, corresponding to the status of the inner stroke.

If any of the internal pressures of the oil chamber 8 of the outer connecting rod connector part 7, hydroblank holder air tank or the outer balance tank 16, is judged to be within the range of predetermined abnormal values, a warning instruction or press operation termination instruction is transmitted by controller 1, depending on the gravity of the situation. If a malfunction is found in hydroblank holder 13, the displacement sensor which detects its piston stroke transmits an abnormal function signal to controller 1. Controller 1 then transmits either the warning instruction or the press operation terminating instruction.

If the oil accumulation in hydroblank holder air tank 13 exceeds a predetermined value, an excess oil accumulation signal is transmitted from fluid quantity sensor 20 to controller 1. In response, a drainage instruction is transmitted by controller 1. Therefore, the press output variation which is caused by the air volume change due to the oil accumulation in the hydroblank holder air tank is minimized.

The output values at four points are thus detected by load cells included in the press machine to correct and control the internal pressure of the hydroblank holder air tank to keep the output balance within the predetermined value so that self-diagnosis function of the press conditions can be steadily obtained.

In the apparatus of the present invention when the forming cycles reach predetermined points, the prestored pressure values corresponding to the inner stroke are changed within controller 1.

With the method of the present invention, as the internal pressures of oil chamber 8 of outer connection rod connector part 7, hydroblank holder air tank 13 and of outer balance tank 16 are controlled so as to change automatically corresponding to the change of the inner stroke during the forming process, manual operation of the predetermination of the press conditions is minimized and the reject rate is reduced. Moreover, the press conditions can be preset to the required pressure values accurately so that the quality of the formed products can be improved.

With the apparatus of the present invention, automatic correction can be performed while the change of the preset press pressure is continuously observed during the forming press, and also defective products can be found immediately the forming press. Moreover, when the press machine is replaced or the die accuracy is corrected, the press conditions of every forming cycle can be automatically predetermined and amended in a short time by controller 1 at the time of the upper dead point of the inner die. Thus, stability can be maintained within guaranteed limits. Also, when a malfunction due to oil leakage of the hydraulic pressure system or the like occurs, the trouble can be automatically found and judged by controller 1 and the troublesome task of the conventional die correction is not required.

FIG. 1 shows a block diagram of the apparatus for controlling forming press conditions provided by the present invention. The same reference numerals are given to the constituent elements to those shown in FIG. 2 and FIG. 3, and a separate description of their functions is omitted. In FIG. 1, the reference numeral 1 denotes a controller means which constitutes a main part of the apparatus of the present invention. In this embodiment a microcomputer can be typically used as controller. Controller 1 is provided with an input A/D converter 2, a digital output device 3, an output D/A converter 4 and a group of man-machine interfaces 5 (an indication means) such as a keyboard and a display.

Reference numeral 6 denotes a hydraulic pressure controlling apparatus. Apparatus 6 is provided in a hydraulic pressure circuit, which connects between oil chamber 8 of outer connection rod connector part 7, and oil tank 9. The hydraulic pressure controlling apparatus 6 has a control valve and an amplifier (not shown) and is connected to D/A converter 4 by a signal system. Hydraulic pressure controlling apparatus 6 operates properly in accordance with an instruction signal from controller 1 via D/A converter 4. A relief valve 10 and a hydraulic pump 11 are also provided in the hydraulic pressure circuit between hydraulic pressure controlling apparatus 6 and oil tank 9.

Reference numeral 12 denotes a pneumatic pressure controlling apparatus. Apparatus 12 is provided in a pneumatic pressure circuit connecting between hydroblank holder air tank 13 and a pneumatic source 14. Pneumatic pressure controlling apparatus 12 is provided with an exhaust valve and a current proportional pneumatic regulator (not shown), and is connected to D/A converter 4 by a signal system. Pneumatic pressure controlling apparatus 12 operates in accordance with an instruction signal from controller 1 via D/A converter 4.

Reference numeral 15 denotes a pneumatic pressure controlling apparatus of a similar structure as the pneumatic pressure controlling apparatus 12. Apparatus 15 is provided in a pneumatic pressure circuit connecting between outer balance air tank 16 and pneumatic source 14. Pneumatic pressure controlling apparatus 15 is connected to D/A converter 4 and operates properly in accordance with an instruction signal from the controller 1 via D/A converter 4.

The reference numeral 17 denotes a displacement sensor. Displacement sensor 17 detects the operation displacement of piston rod **18*c* of hydroblank holder 18 and produces a detecting signal proportional to the displacement of piston rod 18*c* of the hydroblank holder 18. Displacement sensor 17 is connected to A/D converter 2 by a signal system, through a signal processor 19, which can typically be an amplifier. When the detecting signal of displacement sensor 17 is transmitted to controller 1, controller 1 thus obtains an indication of the operation displacement of piston rod 18*c* of hydroblank holder 18. Controller 1 then displays the displacement of every stroke on the group of the man-machine interfaces 5. At the same time, a warning instruction is indicated if the displacement of piston rod 18*c*** reaches a certain predetermined range.

Reference numeral 20 denotes a fluid level sensor. Sensor 20 detects the level of the surface of accumulated oil in the hydroblank holder air tank 13. Fluid level sensor 20 is connected to A/D converter 2 by a signal system through a signal processor 21, which can be for instance an amplifier. When the detecting signal of the fluid level sensor 20 is transmitted to controller 1, controller 1 converts the fluid level of the accumulated oil in the hydroblank holder air tank 13 into a fluid quantity and displays this fluid quantity on the group of the man-machine interfaces 4. At the same time, if the fluid quantity reaches a certain predetermined value, a warning instruction is indicated. A sensor which detects the oil quantity in hydroblank holder air tank 13 directly may be used in place of fluid level sensor 20.

The reference numeral 22 denotes a pneumatic pressure sensor. Sensor 22 which the internal pressure of hydroblank holder air tank 13 when a solenoid valve 23 is ON. The sensor output (detecting signal) is connected to A/D converter 2 by a signal system through a signal processor 24, which is for instance an amplifier. When the detecting signal of the pneumatic pressure sensor 22 is transmitted to controller 1, controller 1 determines and controls the internal pressure of the hydroblank holder air tank 13, corresponding to the change of an inner stroke, in accordance with a signal of an inner stroke sensor 25.

The reference numeral 26 denotes a hydraulic pressure sensor which detects the internal pressure of the oil chamber 8 of the outer connection rod connector part 7 when a solenoid valve 27 is ON. Sensor 26 connected to A/D converter 2 by a signal system through a signal processor 28, which may be, for instance, an amplifier. When the detecting signal of the hydraulic pressure sensor 26 is transmitted to controller 1, controller 1 determines and thereby obtains a feedback loop for controlling the internal pressure of oil chamber 8 of the outer connection rod connector part 7. This pressure is controlled corresponding to the change of an inner stroke in accordance with a signal of inner stroke sensor 25.

The reference numeral 29 denotes a pneumatic pressure sensor which detects the internal pressure of outer balance air tank 16 when a solenoid valve 30 is ON. Sensor 29 is connected to A/D converter 2 by a signal system through a signal processor 31, which is for instance an amplifier. The detecting signal of pneumatic pressure sensor 29 is transmitted to controller 1, and controller 1 determines and controls the internal pressure of the outer balance air tank 16. This pressure is controlled corresponding to the change of an inner stroke in accordance with a signal of inner stroke sensor 25.

The reference numerals 23, 27 and 30 denote solenoid valves which are controlled by an ON-OFF signal from digital output device 3 under the instruction of controller 1 and properly predetermines the timing operation of sensors 22, 26 and 29, respectively. The reference numeral 32 denotes a solenoid valve controlled by digital output device 3 and which discharges the oil in the hydroblank holder air tank 13 onto an oil sink 33 to avoid malfunctions caused by the change of the air volume in the hydroblank holder air tank 13.

The reference numeral 19 denotes a temperature sensor which detects the surface temperature of a die. The detecting signal of sensor 49 is connected to A/D converter 2 by a signal system. The reference numerals 34, 35 and 36 denote amplifiers provided between D/A converter 4 and hydraulic pressure controlling apparatus 6, the pneumatic pressure controlling apparatus 12 and the pneumatic pressure controlling apparatus 15, respectively. The reference numeral **48*a* denotes a piston rod and the reference numeral 48*b*** denotes an air chamber.

The practical operation of the apparatus for controlling forming press conditions of the above embodiment is explained herein.

Figure 2:
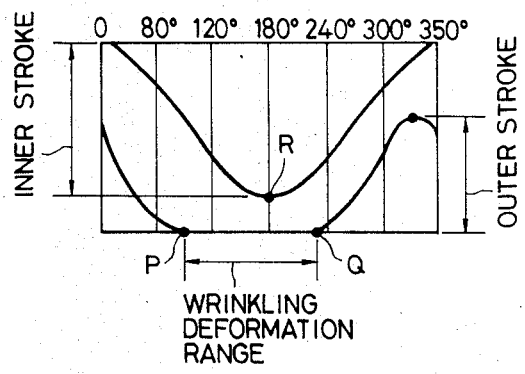
FIG. 2 is a correlation diagram showing the relation between the crank angle, the inner stroke and the outer stroke.
Figure 3:
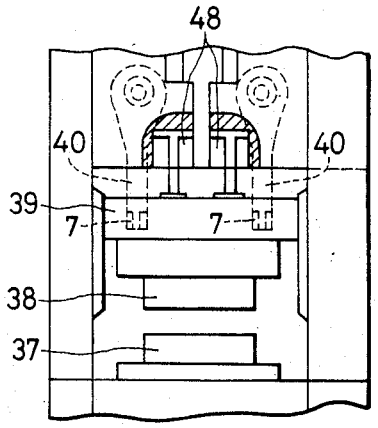
FIG. 3 is a schematic view which shows an essential part of an example of the structure of a mechanical double action press machine.
Figure 4:
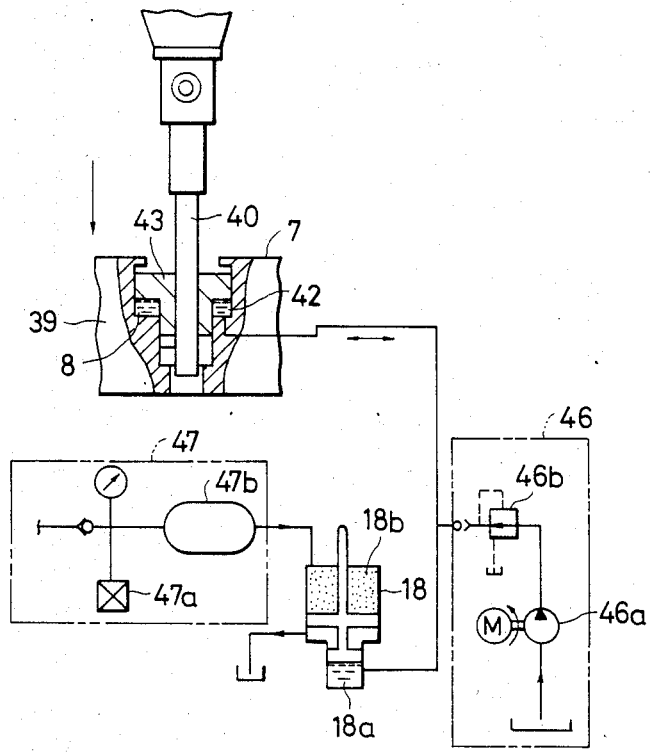
FIG. 4 PRIOR ART
FIG. 4 is a block diagram of the apparatus for controlling press conditions provided by the prior art.

There are correlations between a crank angle of a driving shaft (not shown) of a press machine and an inner stroke and an outer stroke as shown in FIG. 2. Namely, while an outer ram 39 is at the lower dead point state between crank angles of about 180° and 210° (between points P and Q in FIG. 2), an inner die is in the lower dead point at about 180° (at the point R in FIG. 2). The range between the points P and Q is the range where wrinkling deformation occurs from the distortion of outer connection rod 40. Also draw-forming is performed by the inner within this range. Therefore, the outer load, within the range where the wrinkling deformation is generated, can be controlled by properly changing the hydraulic pressure of oil chamber 8 of outer connection rod connector part 7, the pneumatic pressure of the hydroblank holder air tank 13 and the pneumatic pressure of the outer balance air tank 6. The position of the forming press within a stroke is detected as follows. When the outer ram 39 initially reaches the lower dead point, it is detected by hydraulic pressure sensor 26. This detecting signal is transmitted to controller 1. In addition, the inner stroke information is detected by inner stroke sensor 25 and transmitted to controller 1. Respective pressures of oil chamber 8, outer connection rod connector part 7 of outer ram 39, internal chamber in hydroblank holder air tank 13 and internal chamber of outer balance air tank 16 are detected by the hydraulic pressure sensor 26 and the pneumatic pressure sensors 22 and 29, respectively. The detection signals are coupled to controller 1 through signal processors 28, 24 and 31 and A/D converter 2. At that time, the operation timings of the hydraulic pressure sensor 26, and the pneumatic pressure sensor 22 and 29 are predetermined in a suitable period which includes at least one of either the upper or lower dead point of the inner. The operation of sensors 26, 22 and 28 are controlled by solenoid valves 27, 23 and 30, respectively, which are operated by the instructions from controller 1.

During a forming process, the detecting signals from displacement sensor 17, fluid level sensor 20 and temperature sensor 49 (similar to signals from sensors 25, 26 and 29), are transmitted to controller 1, either continously or intermittently. The information obtained from the various sensors 25, 26, 29, 22, 17, 30 and 49 is indicated on a display in the group of the man-machine interfaces 5.

When the signals from hydraulic pneumatic pressure sensors 26, 22 and 29 are input into controller 1, controller 1 compares those detected values to the predetermined values which have been memorized beforehand by controller 1. These memorized values correspond to different desired conditions during different positions of the inner stroke. Based on these memorized and input values, controller 1 makes a judgement. In this case, if any one detected value among those of the hydraulic and pneumatic pressure sensors 26, 22 and 29 varies greatly from the predetermined value, and thus falls within the range of abnormal values, the warning instruction is indicated immediately on the display in the group of the man-machine interfaces 5. Depending on the situation, a press machine operation termination instruction may also be transmitted.

The termination of the press machine operation is not carried out if any one of the above detected values varies only slightly from the predetermined value. In this case, controller 1 transmits the respective instruction signals from A/D converter 4 to hydraulic or pneumatic pressure controlling apparatus 4, 6 or 15, so as to make the detected values of hydraulic and pneumatic pressure sensors 26, 22 and 29 coincide to the respective predetermined values at the forming stroke. When these controlling apparatuses 6, 12 and 15 receive the instruction signals from controller 1, controlling apparatuses 6, 12 and 15 correct the respective internal pressures of oil chamber 8 of outer connection rod connector part 7, hydroblank holder air tank 13 and outer balance air tank 16. This is done to make those pressure values coincide to the above predetermined values corresponding to the change of the inner stroke in accordance with the instruction signals.

Note that, during the forming process, if a malfunction of piston rod **18*c* of hydroblank holder 18 occurs, the trouble is detected by displacement sensor 17. This signal is transmitted to controller 1 and a warning instruction is immediately indicated with the group of the man-machine interfaces 5. Depending on the situation, the press machine operation terminating instruction may be transmitted by the controller 1**.

Moreover, if the level of the accumulated oil in hydroblank holder air tank 13 exceeds a certain value, the level is detected by fluid level sensor 20 and the signal is transmitted to controller 1 and a drainage instruction is transmitted by controller 1. The system may transmit the drainage instruction periodically from controller 1 with a predetermined interval.

If the production lot size is increased and the surface temperature of a die is raised, the raised temperature is detected by temperature sensor 49. An indicative signal is then transmitted to controller 1. Controller 1 determined the optimum internal pressure of hydroblank holder air tank 13 corresponding to the surface temperature of the die in accordance with the information from the temperature sensor 49. An instruction signal is then transmitted from D/A converter 4 to pneumatic pressure controlling apparatus 12 to change the pneumatic pressure of hydroblank holder air tank 13. This changed pressure corresponds depends on the surface temperature of the die at the time of, for instance, the upper dead point of both inner die 38 and outer ram 39. With this procedure, irregular contact between the workpiece and the die is prevented, and even if the number of the forming cycles is large, the work proceeds smoothly without adjusting the predetermined pressure manually.

Although only a few exemplary embodiments of this invention have been described in detail above, those skilled in the art will readily appreciate that many modifications are possible in the exemplary embodiments without materially departing from the novel teachings and advantages of this invention.

Accordingly, all such modifications are intended to be included within the scope of this invention as defined in the following claims.

What is claimed is:

1. A mechanical double action press machine apparatus which controls forming conditions, said press machine comprising:

ram means for forming a material under pressure;

means for detecting a position of said press machine in a stroke operatively coupled to said ram;

pressure tank means operatively coupled to said ram means for applying a pressure to said ram to move said ram relative to a workpiece;

hydraulic source means operatively coupled to said pressure tank means for selectively applying hydraulic pressure to said pressure tank means to selectively vary said pressure applied to said ram;

pneumatic source means operatively coupled to said pressure tank means for selectively applying pneumatic pressure to said pressure tank means to selectively vary said pressure applied to said ram;

means for sensing said pressures in said tank and producing signals indicative thereof operatively coupled to said tank; and controller means operatively coupled to said detecting means, said sensing means, and said tank for: (1) memorizing data points corresponding to desired pressure values at different positions in said stroke as detected by said detecting means, (2) comparing said data points to said indicative signals, and (3) adjusting said pressures to match said data points, thereby maintaining said ram at different desired pressure at different desired positions in a stroke.

2. An apparatus as in claim 1 further comprising display means operatively coupled to said controller means for displaying said sensed pressure, said desired pressure and said position of said ram.

3. A device as in claim 1 wherein said controller means includes means for producing, in response to said position detecting means, a signal indicative of a malfunction when said press machine position exceeds predetermined limits.

4. A device as in claim 1 wherein said controller means includes means for detecting whether said signals from said sensing means are within a range of predetermined abnormal values, and reports a malfunction when said signals are within said range.

5. A device as in claim 1 further comprising:

an oil reservoir operatively coupled to said hydraulic source means;

fluid quantity sensor means operatively coupled to said oil reservoir for detecting excess oil in said oil reservoir; and drainage means operatively coupled to said oil reservoir for draining said excess oil in response to said excess oil detecting.

6. A mechanical double action press machine comprising:

ram means for forming materials;

inner stroke sensor means operatively coupled to said ram for detecting an inner stroke of said ram means and producing a signal indicative thereof;

an oil chamber under pressure operatively coupled to said ram means for moving said ram means;

hydraulic pressure sensor means operatively coupled to said oil chamber for detecting internal pressure of said oil chamber;

a pressure tank containing a liquid and a gas both under pressure operatively coupled to said ram means for applying a pressure to said ram means to move said ram means relative to a workpiece;

pneumatic pressure sensor means operatively coupled to said tank for detecting internal pressure of said pressure tank;

a balance air tank operatively coupled to said ram means for applying force to said ram means to move said ram means relative to a workpiece;

pressure sensor means operatively coupled to said balance tank for detecting internal pressure of said balance tank;

control means operatively coupled to each of said sensor means for: (1) determining desired pressures for said oil chamber, pressure tank and balance air tank in relation to said position of said ram means sensed by said inner stroke sensor means, (2) comparing said desired pressure to pressures monitored by said hydraulic pressure sensor means, said pneumatic pressure sensor means and said pressure sensor means and (3) controlling said pressure tank to cause said monitored pressures to approach said desired pressures so that pressure applied by said ram means can be maintained as desired for all positions of said ram means.

7. An apparatus for controlling forming press conditions as in claim 6, further comprising indication means coupled to said controller for displaying current system status.

8. An apparatus for controlling forming press conditions as in claim 6, further comprising oil sensor means operatively coupled to said pressure tank for detecting oil quantity in said pressure tank.

9. A method for controlling forming press conditions in a mechanical double action press machine comprising the steps of:

detecting the position of an inner stroke of a ram means for forming materials in said press machine;

detecting the internal pressure of an oil chamber defined between said ram means and an outer connector rod operatively coupled thereto, said oil chamber controlling the pressure of said press machine;

detecting the internal pressure of a pressure tank, said pressure tank controlling said pressure of said oil chamber;

detecting the internal pressure of an outer balance tank operatively coupled to said ram means, said outer balance tank producing a pressure for moving said ram means relative to a workpiece; and altering automatically said detected internal pressure values to coincide to predetermined pressure values corresponding to a change of said inner stroke.

* * * * *